US005929884A

United States Patent [19]

Hetzer et al.

[11] Patent Number: 5,929,884

[45] Date of Patent: Jul. 27, 1999

[54] DEVICE FOR PREVENTING RE-USE OF A CONTAINER FOR SUPPLYING INK

[75] Inventors: Ulrich Hetzer; Michael Seikel, both of Berlin, Germany

[73] Assignee: Francotyp Postalia AG & Co., Birkenwerder, Germany

[21] Appl. No.: 08/838,411

[22] Filed: Apr. 7, 1997

[30] Foreign Application Priority Data

Apr. 6, 1996 [DE] Germany ..... 196 13 943

[51] Int. Cl.[6] ..... B41J 2/175

[52] U.S. Cl. ..... 347/86

[58] Field of Search ..... 347/84, 85, 86, 347/29, 49

[56] References Cited

U.S. PATENT DOCUMENTS

| | | | |
|---|---|---|---|
| 5,027,872 | 7/1991 | Taylor | 141/347 |
| 5,283,593 | 2/1994 | Wehl | 347/86 |
| 5,425,478 | 6/1995 | Kotaki | 225/501 |

FOREIGN PATENT DOCUMENTS

| | | |
|---|---|---|
| 57 201 673 | 12/1982 | European Pat. Off. . |
| 02 016 057 | 1/1990 | European Pat. Off. . |
| 0 610 965 A1 | 8/1994 | European Pat. Off. . |
| 27 09 730 | 12/1981 | Germany . |
| 27 28 283 | 4/1982 | Germany . |
| 2 133 502 | 7/1984 | United Kingdom . |
| WO 90/00971 | 2/1990 | WIPO . |
| 90/00976 | 2/1990 | WIPO . |

*Primary Examiner*—N. Le
*Assistant Examiner*—Michael Nghiem
*Attorney, Agent, or Firm*—Herbert L. Lerner; Laurence A. Greenberg

[57] ABSTRACT

A device for preventing re-use of a container for supplying ink to an ink printing head has high functional security, only allows the use of new fresh ink containers prescribed by the printer manufacturer and suppresses the use of fresh ink containers that have already been in operation and were then refilled. An ink connecting line from the ink printing head to the fresh ink container is docked in a known manner through the use of a hollow needle that is passed through a rubber-elastic closure. Two electrodes in the bottom of the fresh ink container are also part of an ink exhaustion detector in a known manner. A cover device for at least one electrode can be tripped irreversibly through the use of the hollow needle the first time it is inserted.

7 Claims, 2 Drawing Sheets

DEVICE FOR PREVENTING RE-USE OF A CONTAINER FOR SUPPLYING INK

BACKGROUND OF THE INVENTION

1. Field of the Invention

The invention relates to a device for preventing re-use of a container for supplying ink to an ink printing head.

Such ink printing heads are used both in typical office printers and in small high-speed printers. The latter are components of modern machines for printing addresses or for product labeling and will soon also be part of machines for applying postage to mail.

The function of the printing heads should be assured in such a way that if at all possible no missing ink dots will occur. That is important not only for the sake of the printed image quality in general but also and in particular for security-relevant printed image data, such as the monetary value, the date and the serial number of the machine in the case of postage printing. If missing ink dots and damage to the printing head are to be prevented, among other requirements the supply of the proper ink for the ink printing head must be absolutely assured to be as free of bubbles as possible.

It is conventional (see German Patent DE 27 09 730 C2) for the ink connecting line from the ink printing head to the container for the ink supply, which is referred to below as the fresh ink container, to be docked on the ink container through a hollow needle. The ink container is provided with a rubber-elastic closure that is pierced by the hollow needle. That prevents both the invasion of air into the ink connecting line and an unintended escape of ink from the ink container. However, with that docking principle, it is possible for partly or entirely emptied fresh ink containers to be refilled with any arbitrary ink by unauthorized persons and inserted into the printer. That can cause failure or even damage to the ink printing head.

In order to provide reliable ink supply, it is important to detect when the ink runs out and to signal that occurrence in good time. An ink exhaustion detection device is known (see German Patent DE 27 28 283 C2) in which two electrodes pass all the way through the bottom of the fresh ink container, and a transition resistance between the electrodes is measured and evaluated. The electrodes are disposed in wells that are molded into the container bottom. The prerequisite for the use of that kind of ink exhaustion detection is the use of an electrically conductive ink.

2. Summary of the Invention

It is accordingly an object of the invention to provide a device for preventing re-use of a container for supplying ink, which overcomes the hereinafore-mentioned disadvantages of the heretofore-known devices of this general type and which increases functional security. It is additionally an object of the invention to develop a device for preventing re-use that allows the use of only new fresh ink containers prescribed by the printer manufacturer and prevents the use of fresh ink containers that have already been in operation and then refilled, while preserving the initially described docking of the fresh ink container and an ink exhaustion detection through the use of electrodes disposed in the latter.

With the foregoing and other objects in view there is provided, in accordance with the invention, in an assembly having an ink printing head, an ink connecting line connected to the ink printing head, a container with a bottom and a rubber-elastic closure for supplying ink to the ink printing head, a hollow needle docking the ink connecting line on the container through the closure, and at least two electrodes fitted through the bottom of the container as part of an ink exhaustion detection, a device for preventing re-use of the container, comprising a cover device for at least one of the electrodes, the cover device tripping irreversibly upon initial insertion of the hollow needle.

In accordance with another feature of the invention, there is provided at least one annular bead surrounding and protruding past at least one of the electrodes.

In accordance with a further feature of the invention, the at least one bead is rubber-elastic.

In accordance with an added feature of the invention, the bottom of the container has a well molded therein with an edge, the at least one electrode is fitted into the well, and the edge of the well protrudes past the at least one electrode.

In accordance with an additional feature of the invention, the cover device includes a shaft, a rocker supported rotationally movably about the shaft, two bearing blocks for the shaft, a resilient detent hook for the rocker, and a compression spring biasing the rocker.

In accordance with a concomitant feature of the invention, the rocker has a first, short lever arm with an end and a protrusion on the end for locking on the detent hook, and the rocker has a second, long lever arm with a lateral tooth as a stop for the hollow needle and an end with a lining for covering the electrode or the bead.

Since a covering device for at least one of the electrodes can be tripped irreversibly once and for all through the use of the hollow needle for the ink docking, the exhaustion of the ink is signaled at all times for a fresh ink container once docked, although after the hollow needle has been pulled out, regardless of how much ink is still left in the device for preventing re-use.

A fresh ink container that has been undocked once and then redocked can accordingly no longer be used for the ink supply but instead can then be used, if at all, only for ink disposal, as a waste ink container.

Other features which are considered as characteristic for the invention are set forth in the appended claims.

Although the invention is illustrated and described herein as embodied in a device for preventing re-use of a container for supplying ink, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 2*a*, 2*b* and 2*c* are sectional views taken along a line II—II of FIG. 1*a,* in the direction of the arrows, showing details of the covering device, wherein FIG. 2*a* shows a hollow needle inserted before reaching a securing lever, FIG. 2*b* shows the hollow needle inserted and the cover device unlocked, and FIG. 2*c* shows a location of the cover device after the hollow needle has been pulled out.

DESCRIPTION OF THE PREFERRED EMBODIMENTS

Figure 1B:
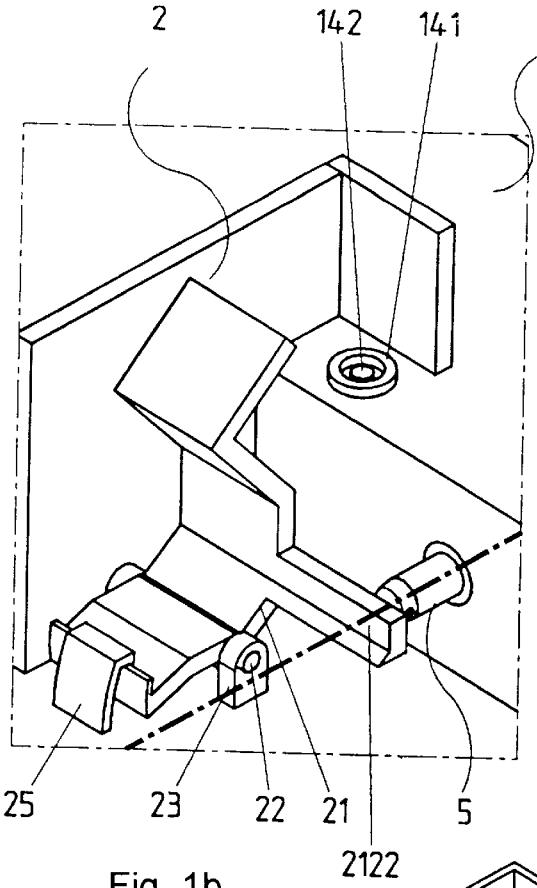
FIG. 1*b* is an enlarged, perspective view of a portion b of FIG. 1*a*, showing details of ink docking and a cover device.
Figure 1C:
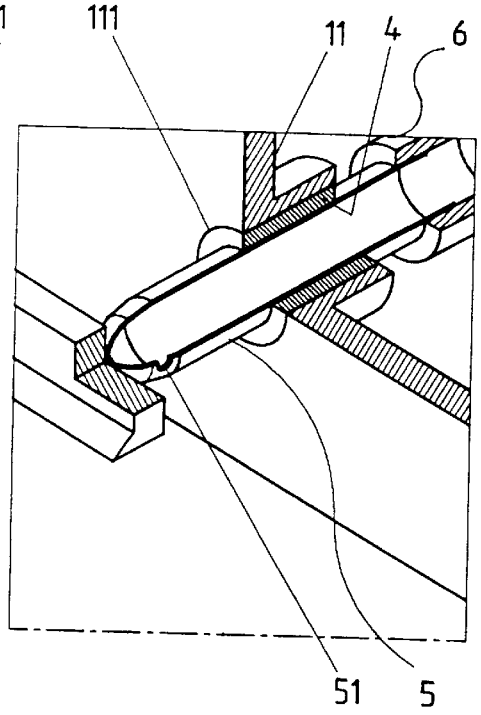
FIG. 1*c* is an enlarged, perspective view of a portion c of FIG. 1*a*, also showing details of the ink docking and the cover device.
Figure 1A:
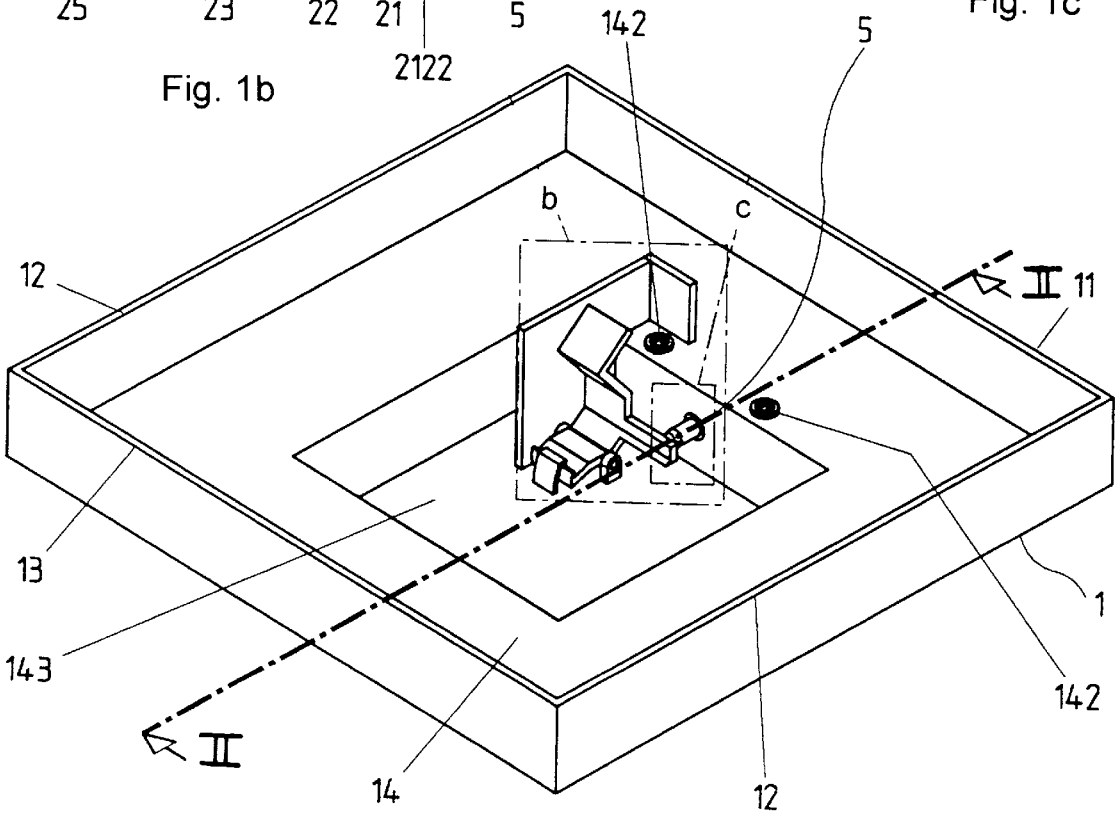
FIG. 1*a* is a diagrammatic, perspective view of a fresh ink container.

Referring now in detail to the figures of the drawings, which are partly diagrammatic for the sake of simplicity and better comprehension, and first, particularly, to FIGS. 1*a*, 1*b* and 1*c* thereof, there is seen a fresh ink container 1 that has a bore 111 in a front wall 11 thereof and a rubber-elastic closure or stopper 4 inserted in the bore. A hollow needle 5 is inserted through the rubber-elastic closure 4 and is connected through an ink connecting line 6 to an ink printing head in a non-illustrated manner. Side walls 12 and a back wall 13 of the fresh ink container are constructed as smooth walls without leadthroughs. A well-like depression 143 is machined into the bottom 14 and the hollow needle 5 discharges into the vicinity of the depression. The hollow needle 5 has an ink opening 51 on its side. Two electrodes 142 which are fitted into the bottom 14 and disposed outside the depression 143 toward the front wall 11, are surrounded by a bead 141 protruding past them.

A cover device 2 is disposed on the bottom 14 in the depression 143. The cover device 2 substantially includes a rocker 21 supported rotationally movably about a shaft 22, two bearing blocks 23 for the shaft 22, a resilient detent hook 25 as well as a compression spring 24, which is seen in FIG. 2.

The cover device 2 which is disposed on the bottom 14 is constructed in such a way that it is located partly in an insertion region of the hollow needle 5. For this purpose, there is a tooth 2122 on the rocker 21.

Figure 2A:
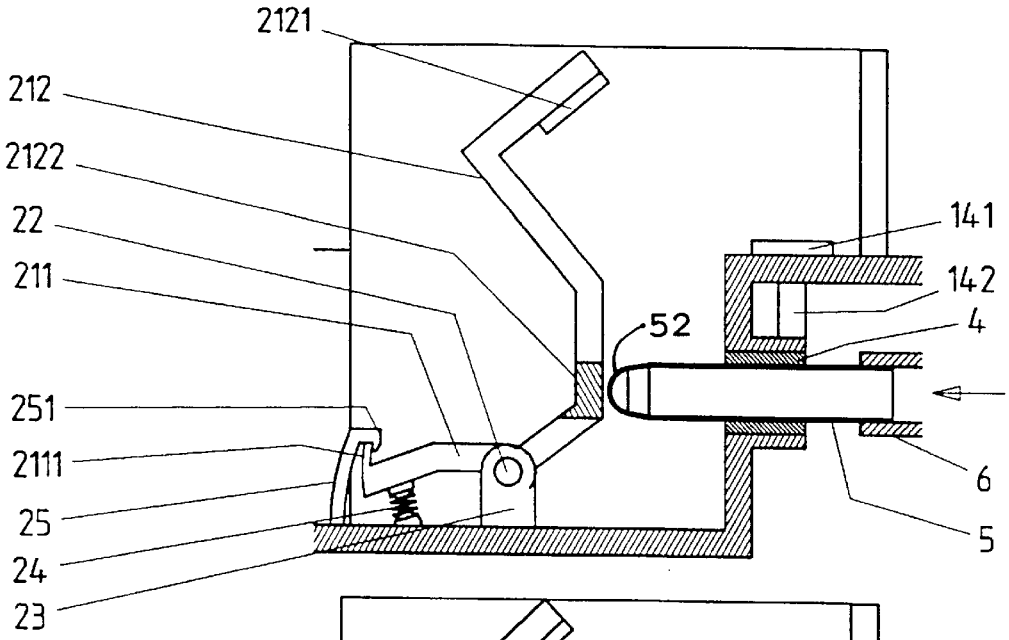
Figure 2B:
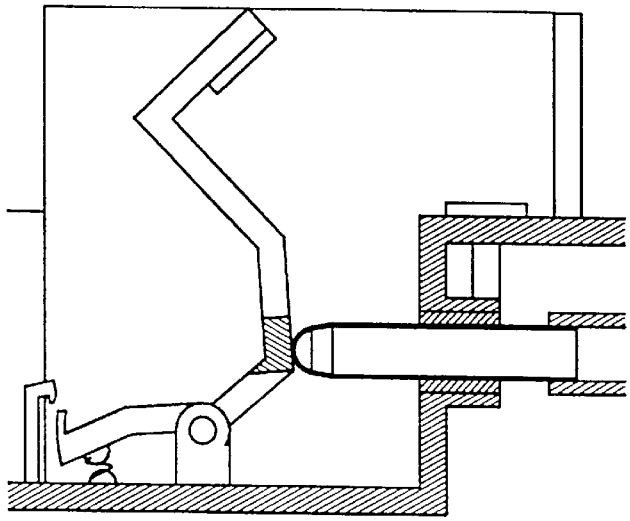
Figure 2C:
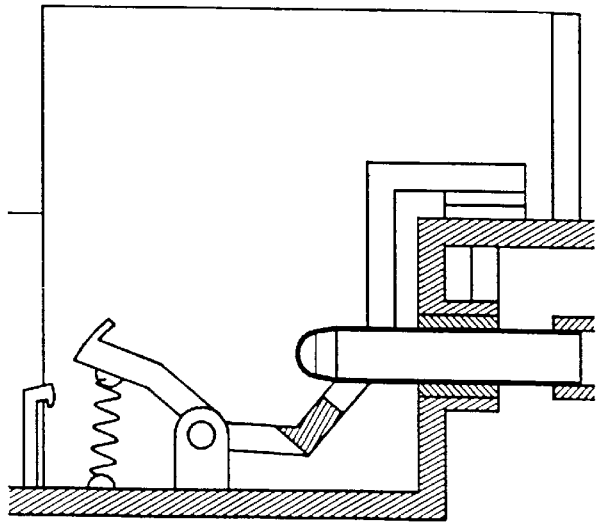

Details of the structure and operation are shown in FIG. 2. Before the hollow needle 5 enters into operative connection with the rocker 21, the rocker is locked on the detent hook 25 with a first, short, hook-like lever arm 211 of the rocker 21, as is seen in FIG. 2*a*. To that end, the detent hook 25 is provided with a protrusion 251 and the short lever arm 211 is also provided with a protrusion 2111. The detent hook 25 is bent elastically in the direction of the short lever arm 211, so that the protrusions 251, 2111 are hooked force-lockingly onto one another. A force-locking connection is one which connects two elements together by force external to the elements, as opposed to a form-locking connection which is provided by the shapes of the elements themselves. The short lever arm 211 is also spring-supported by the compression spring 24 toward the bottom 14 and is forced by this spring upward against the detent hook 25. In this way, the fresh ink container 1 is adequately secured against unintended tripping of the cover device 2.

A second, somewhat longer lever arm 212 is constructed in such a way that an electrode 142 and the insertion region of the hollow needle 5 are located in its pivoting range. The lever arm 212 is provided on the inside of its end with a suitably adapted lining 2121 for secure covering of the electrode 142 and of the bead 141 surrounding it. The inserted hollow needle 5 has a tip 52 which rests force-lockingly on the front surface of the tooth 2122 formed onto the lever arm 212 in the insertion region of the hollow needle 5. Once the tip of the hollow needle 5 meets the front surface of the tooth 2122, the long lever arm 212 is forced upward and the short lever arm is forced downward counter to the spring force of the compression spring 24. As a consequence, the detent hook 25 is released and moves out of the pivoting range of the short lever arm 211, as is seen in FIG. 2*b*. The cover device 2 is thus unlocked. The tooth 2122 of the long lever arm 212 rests force-lockingly on the hollow needle 5, depending on the leverage ratio between the two levers arms 211, 212 and the engagement point of the compression spring 24 and the attachment point of the tooth 2122. If the hollow needle 5 is pulled out, then the rocker 21 is pivoted by the compression spring 24 so far around the shaft 22 that the lining 2121 rests force-lockingly on the bead 141, and the tooth 2122 is located below the insertion region of the hollow needle 5. If the hollow needle 5 is inserted again, the rocker 21 remains in the position described. The electrical connection between the two electrodes 142 is thus disrupted and is evaluated continuously as the exhaustion or depletion of the ink. Therefore, renewed printing operation with the fresh ink container is no longer possible.

We claim:

1. A printing assembly, comprising:

an ink printing head, an ink connecting line connected to said ink printing head, a container with a bottom and a rubber-elastic closure for supplying ink to said ink printing head, a hollow needle docking said ink connecting line on said container through said closure, at least two electrodes fitted through said bottom of said container for ink exhaustion detection, a cover device for at least one of said electrodes, a fastener holding said cover device in an initial position, said cover device tripping irreversibly said fastener upon initial insertion of said hollow needle moving said cover device to a final position preventing re-use of said container.

2. The printing assembly according to claim 1, including at least one annular bead surrounding and protruding past at least one of said electrodes.

3. The printing assembly according to claim 2, wherein said at least one bead is rubber-elastic.

4. The printing assembly according to claim 1, wherein said bottom of said container has a well molded therein with an edge, said at least one electrode is fitted into said well, and said edge of said well protrudes past said at least one electrode.

5. The printing assembly according to claim 1, wherein said cover device includes a shaft, a rocker supported rotationally movably about said shaft, two bearing blocks for said shaft, a resilient detent hook acting as said fastener for said rocker, and a compression spring biasing said rocker.

6. The printing assembly according to claim 5, wherein said rocker has a first, short lever arm with an end and a protrusion on said end for locking on said detent hook, and said rocker has a second, long lever arm with a lateral tooth as a stop for said hollow needle and an end with a lining for covering said electrode.

7. The printing assembly according to claim 6, including at least one annular bead surrounding and protruding past at least one of said electrodes, said lining covering said bead.

* * * * *